United States Patent [19]

Harada et al.

[11] Patent Number: 4,893,069

[45] Date of Patent: Jan. 9, 1990

[54] FERRORESONANT THREE-PHASE CONSTANT AC VOLTAGE TRANSFORMER ARRANGEMENT WITH COMPENSATION FOR UNBALANCED LOADS

[75] Inventors: Kosuke Harada; Akihiko Katsuki, both of Fukuoka; Fukutoshi Tominaga, Saga, all of Japan

[73] Assignee: Nishimu Electronics Industries Co., Ltd., Fukuoka, Japan

[21] Appl. No.: 358,476

[22] Filed: May 30, 1989

Related U.S. Application Data

[63] Continuation of Ser. No. 249,720, Sep. 7, 1988, abandoned.

[30] Foreign Application Priority Data

Jul. 29, 1988 [JP] Japan ..... 62-162142

[51] Int. Cl.[4] ..... G05F 1/13

[52] U.S. Cl. ..... 323/215; 307/14; 323/248; 323/307; 323/308

[58] Field of Search ..... 363/75; 323/248, 249, 323/250, 253, 254, 306, 307, 308, 215; 307/14, 20, 23

[56] References Cited

U.S. PATENT DOCUMENTS

| | | | |
|---|---|---|---|
| 2,610,991 | 9/1952 | Levy | 307/14 |
| 3,214,681 | 10/1965 | Tango et al. | 323/307 |
| 3,440,516 | 4/1969 | Kaiser | 363/75 |
| 3,889,176 | 6/1975 | Randall | 323/248 |
| 4,238,688 | 12/1980 | Boettcher et al. | 307/20 |
| 4,288,737 | 9/1981 | McClain et al. | 323/254 |
| 4,665,322 | 5/1987 | Eishima et al. | 307/66 |

*Primary Examiner*—William H. Beha, Jr.
*Attorney, Agent, or Firm*—Kinney & Lange

[57] ABSTRACT

A ferroresonant three-phase constant AC voltage transformer comprising three transformer iron cores with one for each corresponding input supply phase, primary windings and secondary windings formed on each of the transformer iron cores, series reactance components or reactors connected in series, with the primary windings, automatic voltage regulating means for controlling secondary output voltages generated at the secondary windings to a predetermined target value, compensating windings formed so as to be inductively coupled to each of the series reactance components or reactors, and means for connecting the compensating windings in series with each other to form a closed loop circuit. The secondary output voltages are theoretically kept in balanced condition even when the loads or the primary input voltages or both are unbalanced.

6 Claims, 7 Drawing Sheets

FERRORESONANT THREE-PHASE CONSTANT AC VOLTAGE TRANSFORMER ARRANGEMENT WITH COMPENSATION FOR UNBALANCED LOADS

This is a continuation of App. Ser. No. 249,720, filed Sept. 7, 1988, now abandoned.

BACKGROUND OF THE INVENTION

1. Field of the Invention:

This invention relates to a ferroresonant three-phase constant AC voltage transformer and, more particularly, to a ferroresonant three-phase constant AC voltage transformer capable of reducing a deviation that can be generated in the phase difference between the output voltages when unbalanced loads or unbalanced three-phase input power source voltages or both are connected thereto.

2. Description of the Prior Art:

A ferroresonant constant AC voltage circuit has a configuration wherein a series circuit consisting of a reactor L2 and a switching element SW is connected in parallel to an output capacitor C and to a load R with each of the latter two also being connected in parallel to each other. These parallel circuits and a reactor L1 are connected in series to an input source of voltage Ei as illustrated in FIG. 6. By controlling the ON-OFF time of the switching element SW with a negative feedback circuit FBC and consequently controlling the input current flowing through the reactor L1, the amount of the voltage drop between the opposite terminals of the reactor L1, which is serially connected between the input and output, can be regulated and the AC voltage Eo applied to the output or load can be kept constant (as disclosed in the specification of U.S. Pat. No. 4,642,549).

In the present specification, the output capacitor C, the reactor L2, the switching element SW, and the negative feedback circuit FBC may be referred to collectively as the "automatic voltage regulating" (AVR) part.

It is permissible, as is widely known, to utilize as the series reactor L1 a leakage inductance of a transformer T which is provided with a magnetic shunt Ms as illustrated in FIG. 7. In this arrangement, it is no longer necessary to add a series reactor as an external circuit component. FIG. 6, therefore, is an equivalent circuit of FIG. 7.

As examples of transformers provided with a magnetic shunt, not only diport transformers configured as illustrated in FIG. 7 but also triport transformers (Japanese patent application disclosure SHO 60(1985)-219,928 and Japanese patent application disclosure SHO 61(1986)-54,513) have been known to the art.

In the conventional constant voltage circuit described above, a phase difference occurs between the phase of the input voltage Ei and the phase of the output voltage Eo because the output voltage Eo is regulated to a target (fixed) value by controlling the magnitude of the electric current flowing in the reactor L1 which is serially connected between the input and output. This phase difference depends on the magnitude of the output current and the power factor of the output (load R). When three constant voltage circuits such as described above are assembled in a three-phase connection and utilized as a three-phase power source, deviations in the phase differences between the input and output voltages cause deviations between the phases of the three output phase voltages.

When the output load is balanced among the three phases, the deviations in phase between the input and output voltages are equal for all three phases. Each of the phase differences between the output voltage phases is 120 degrees for each of the phase differences between the three input voltage phases being 120 degrees. When the load is unbalanced, the phase difference between the input and output voltages is likewise unbalanced among the phases and, as a result, the phase differences of the output phase voltages deviate from 120 degrees.

For example, in a three-phase constant voltage circuit using three diport transformers T1 to T3 as illustrated in FIG. 8, the voltage vectors which are obtained when a load R is applied only on the output U phase of the circuit and no load is applied to the other V and W phases will be as illustrated in FIG. 9.

In the circuit of FIG. 8 there is connected in series, with each of primary (input) windings 12, 22, and 32 of diport transformers T1 to T3 a corresponding one of series reactors L1r to L1t, respectively. These three series reactor-primary winding sets are joined together as phase windings in a delta-connection having input terminals R, S, and T.

The secondary (output) terminals of the diport transformers have corresponding automatic voltage regulating means AVRu to AVRw, of the same configurations as in FIG. 6 and FIG. 7, joined together in a Y connection. N stands for a neutral point. In this case, as clearly noted from the diagrams, a voltage drop V1 occurs only in the series reactor L1r of the U phase while no voltage drop occurs in the reactors L1s and L1t of the V phase and the W phase, respectively. As a result, a phase delay of an amount $\phi$ occurs as illustrated in FIG. 9 in the voltage vector Vun of the output voltage on output U while no phase delay occurs in the voltage vectors Vvn and Vwn of the other voltages present on outputs V and W.

As a result, there arises a loss of balance in the output voltages. The resulting phase differences between the output voltages becomes $(120-\phi)$ degrees between voltages on outputs U and V, 120 degrees between those on outputs V and W, and $(120+\phi)$ degrees between those on outputs W and U.

When such a deviation occurs in the phases of the output voltages of a three-phase power source device, a three-phase motor used as a load may show a decrease in driving torque and may generate a torque ripple to provide a possible cause for noise. When a frequency tripler (multiplier) is used, the deviation of the sort mentioned above may impair the frequency multiplier's capacity for operation. In an extreme case, this deviation may prevent the frequency multiplier from effecting the multiplication aimed at, may degrade the frequency multiplier's capability for keeping a constant output voltage, and may entail various other similar drawbacks.

In the United States, for example, the deviation in the phase difference is required to be prevented from exceeding 3 degrees in a 30% unbalanced load (a load operated under the conditions of 70% in the U phase, 100% in the V phase, and 100% in the W phase, for example). Any attempt at meeting this requirement, however, entails a degradation of the power factor. It is not easy to keep both phase difference and power factor within their allowable limits.

One conceivable way of diminishing the deviation in the phase difference may consist of decreasing the series reactance. This measure, however, entails a disadvantage in that the power capacity on the primary side must be increased because the constant voltage characteristic is degraded and the current-limiting effect to be manifested in the case of secondary short circuit is impaired.

This invention has been made for the purpose of substantially overcoming the drawbacks of the prior art mentioned above.

SUMMARY OF THE INVENTION

The present invention contemplates a characteristic configuration comprising three transformer iron cores with one for each corresponding input supply phase, primary windings and secondary windings formed on each of the transformer iron cores, series reactance components (or reactors) each connected in series with each of the primary windings, automatic voltage regulating means for controlling each of secondary output voltages generated at the secondary windings to a predetermined target value, compensating windings each formed so as to be inductively coupled to each of the series reactance components (or reactors), and means for connecting the compensating windings in series with each other to form a closed loop circuit.

Further, the present invention is characterized by comprising three transformer iron cores with one for each corresponding input supply phase, first and second primary windings and secondary windings formed on each of the transformer iron cores, series reactance components (or reactors) each connected in series with each of the first and second primary windings, automatic voltage regulating means each for controlling secondary output voltages generated at the secondary windings to a predetermined target value, compensating windings each formed so as to be inductively coupled to the series reactance components (or reactors), and means for connecting in series all of the compensating windings corresponding to the first and second windings, to respectively form closed circuits.

Furthermore, the present invention is characterized by having the series reactors, respectively connected in series to corresponding primary windings, formed with magnetic shunts fixed on each of the transformer iron cores for each phase, and the compensating windings also being formed on each of the magnetic shunts.

As is explained above, in this invention, the compensating windings are formed so as to be inductively coupled to the series reactors which are respectively connected in series with the corresponding primary windings formed on the transformer iron cores, and the compensating windings are mutually connected in series to form a closed loop circuit. Therefore, the secondary output voltages are theoretically kept in a balanced condition even when the loads or the primary input voltages or both are unbalanced.

DETAILED DESCRIPTION OF THE PREFERRED EMBODIMENTS

Figure 1:
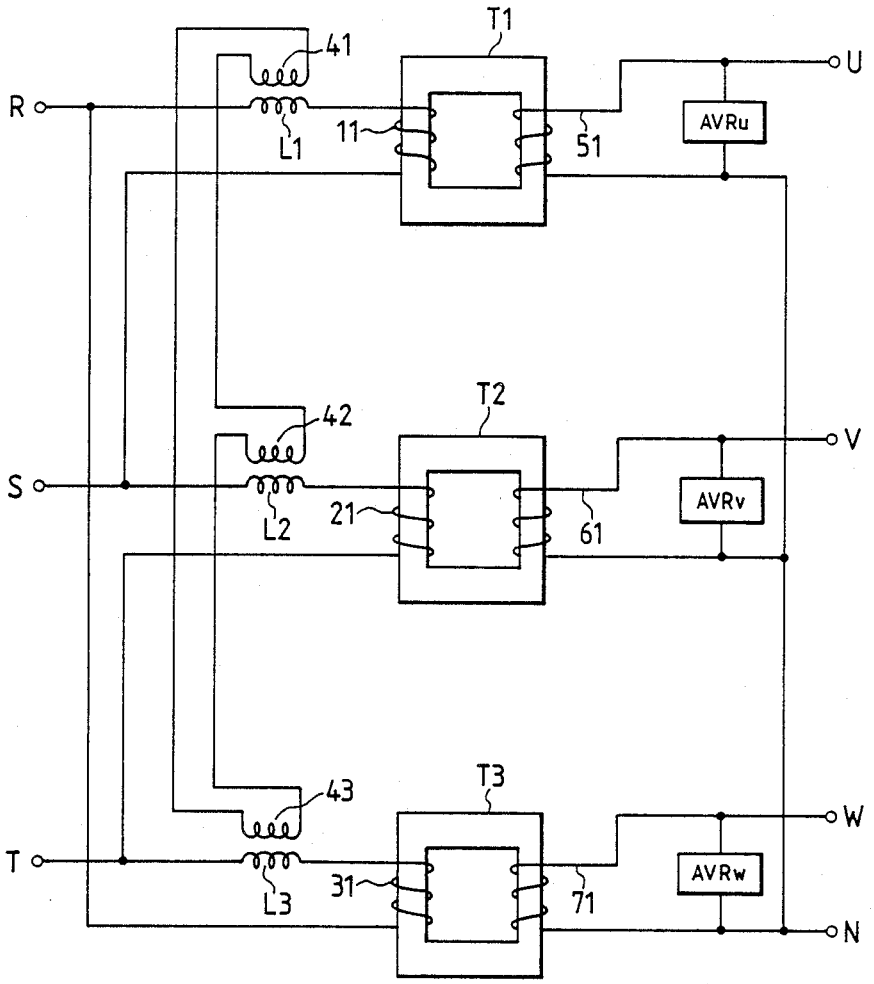
FIGS. 1, 3, 4 and 5 are schematic circuit diagrams, respectively, illustrating the preferred embodiments of the present invention.

FIG. 1 is a circuit diagram illustrating an embodiment of the present invention. The transformers T1, T2 and T3 are each provided with a corresponding one of the primary input windings 11, 21 and 31 a corresponding one of the secondary output windings 51, 61 and 71. The primary windings 11, 21 and 31 are connected, each at one end thereof, to the series reactors L1, L2 and L3, respectively. The three primary winding and series reactor combinations each connected together in as a phase windings and connected to the corresponding three-phase input supply terminals R, S and T, respectively.

The compensating windings 41, 42 and 43 are inductively coupled with the corresponding series reactors L1, L2 and L3, respectively, and these three compensating windings are connected in series with each other in order to form a closed loop circuit. It is desirable that the ratios of number of turns of said series reactor to that of said compensating winding are equal to each other for all the three phases.

Figure 6:
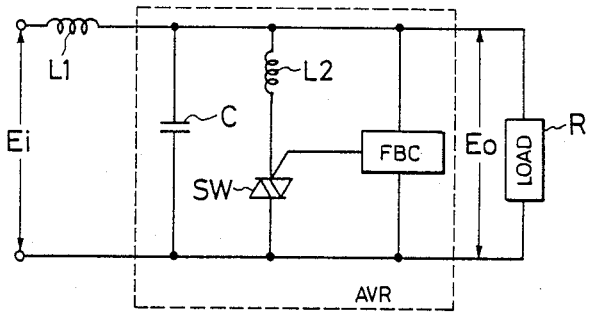
FIG. 6 PRIOR ART
FIGS. 6 and 7 are circuit diagrams illustrating ferroresonant constant AC voltage systems according to the prior art.
Figure 7:
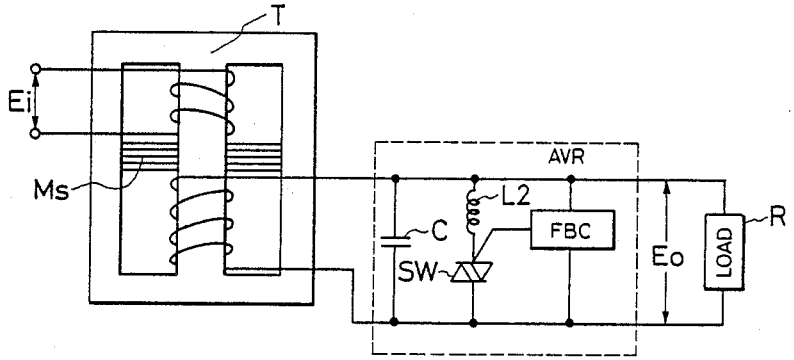
FIG. 7 PRIOR ART

On the secondary sides of the transformers, the secondary windings 51, 61 and 71 are connected, each at one end thereof, to the three-phase output terminals U, V and W, and are connected directly, each at the other end thereof, to the neutral point N, respectively. The constant voltage regulating means AVRu, AVRv and AVRw are inserted between the neutral point N and each of the output supply terminals U, V and W, respectively. These constant voltage regulating means may be arranged similarly to the conventional types illustrated in FIG. 6 or may be suitably arranged otherwise.

Figure 2:
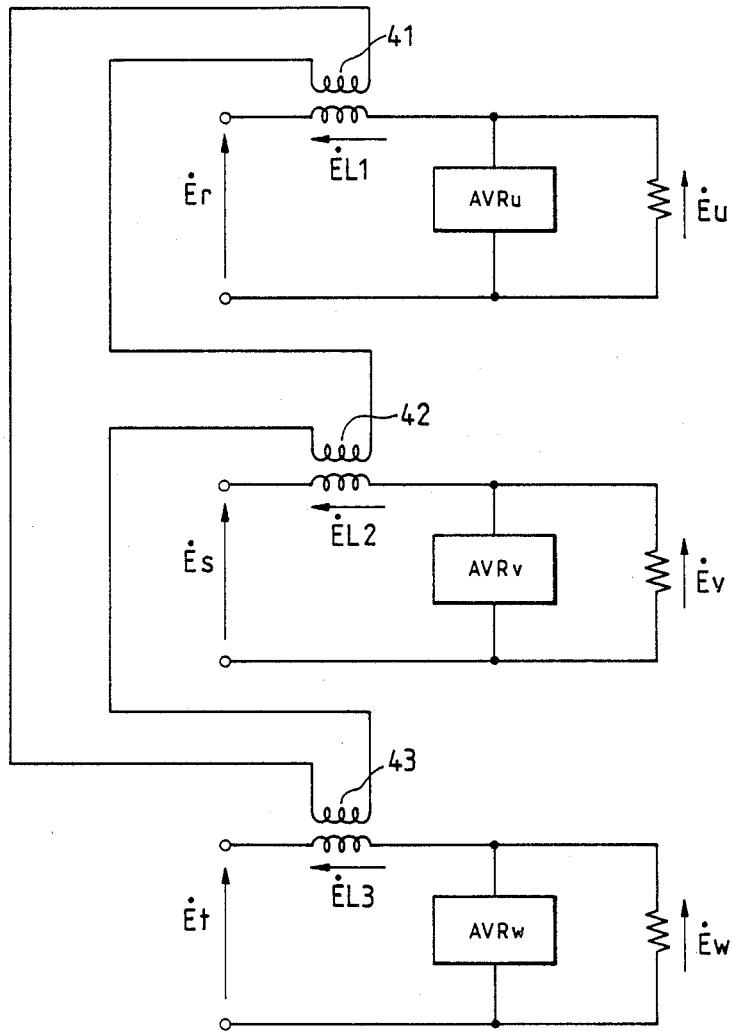
FIG. 2 is an equivalent circuit diagram for explanation of the operation of the present invention.

In the circuit diagram illustrated in FIG. 1, the loads are inserted between each of the output terminals U, V and W and the neutral point N. Assume that the loads for all three phases are different from each other as the most common case. The equivalent circuit for the above case is illustrated in FIG. 2. In FIG. 2, the same symbols as used in FIG. 1 denote identical or equivalent parts.

In FIG. 1 and FIG. 2, since the power source voltage is of three phases and all of the three compensating windings 41, 42 and 43 are connected in series to form a closed loop, the following equations (1) and (2) can be formulated:

$$Er+Es+Et=0 \quad (1)$$

$$EL1+EL2+EL3=0 \quad (2)$$

Subtracting equation (2) from equation (1), the following equation (3) is obtained:

$$(Er-EL1)+(Es-EL2)+(Et-EL3)=0 \quad (3)$$

As is evident from the circuit configuration of FIG. 2, the voltage vectors in the parentheses of equation (3) are each equal to the output voltage vector of its associated phase vectors Eu, Ev and Ew, respectively. According to what is explained above and equation (3), the following equation (4) results.

$$Eu+Ev+Ew=0 \quad (4)$$

By the constant voltage regulating means AVRu, AVRv and AVRw respectively, the output voltages Eu, Ev and Ew are so regulated and controlled that the absolute magnitudes of the three output voltages Eu, Ev and Ew are equal to each other, and are fixed at a value equal to a predetermined target value.

When equation (4) is effective under the condition that the absolute magnitudes of the vectors Eu, Ev and Ew are equal to each other, it is evident that the three phase angles between these vectors, that is, the phase angles between any two of the three output voltages Eu, Ev and Ew, are equal to each other, and should be 120 degrees.

Thus, according to this embodiment of the invention, the compensating windings 41, 42 and 43, which are equal to each other in the number of turns therein, are inductively coupled with a corresponding one of series reactors L1, L2 and L3, respectively, and said compensating windings are connected in series to form a closed circuit. The phases of the secondary output voltages Eu, Ev and Ew, therefore, are capable of being kept balanced even when the loads or the primary input voltages or both are unbalanced to any extent.

It is assumed in the embodiment mentioned above that the three compensating windings are equal in the number of turns therein, and balanced each other. It will be readily inferred that almost the same effects as mentioned above are achieved even when the balance between the compensating windings is not perfect.

Figure 3:
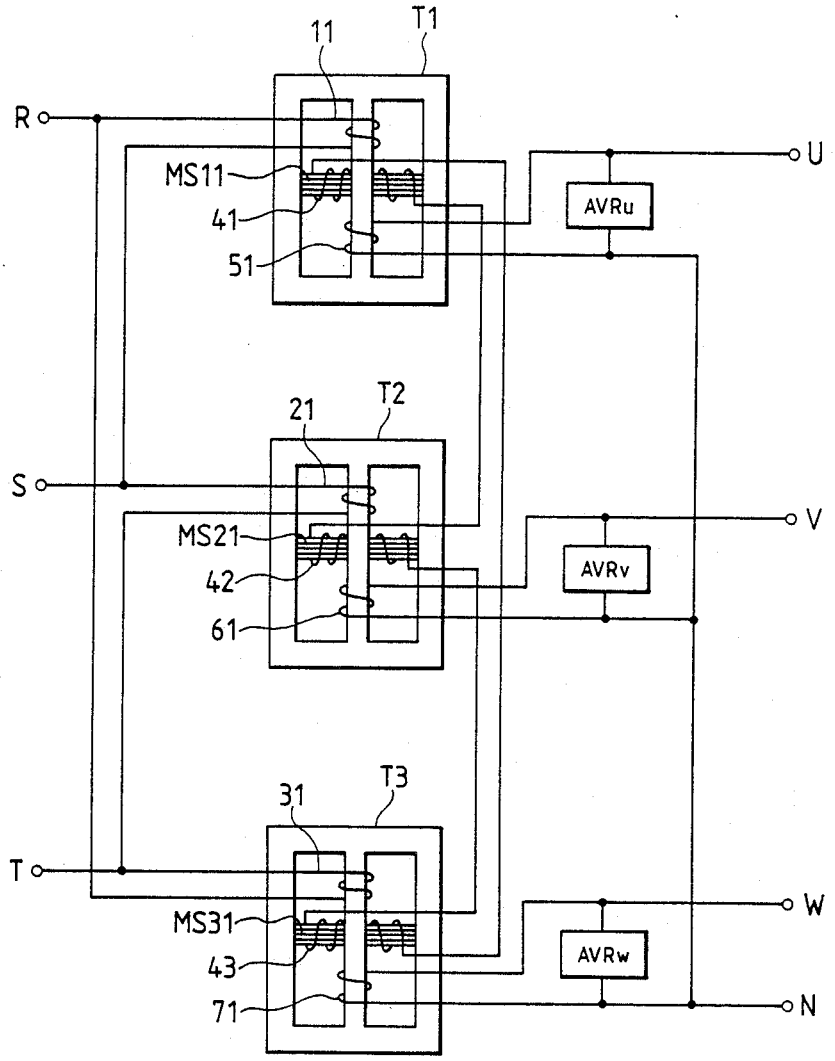

In the embodiment illustrated in FIG. 3, the series reactances formed by the reactors L1, L2 and L3 in the embodiment shown in the FIG. 1 are realized with the magnetic shunts MS11, MS21 and MS31 fixed on the transformers T1, T2 and T3, respectively.

Since the magnetic shunts MS11, MS21 and MS31 are fixed on the transformers T1, T2 and T3, respectively, two winding sections are thereby prepared on each iron core of each transformer. The primary (input) windings 11, 21 and 31 and the secondary (output) windings 51, 61 and 71 are formed in the first and the second winding sections of the transformers T1, T2 and T3, respectively.

Since it is readily inferred by persons with ordinary skill in the art that the present embodiment shown in FIG. 3 is entirely the same as that shown in FIG. 1 in operation, further explanation thereof will be omitted with regard to the embodiment of FIG. 3.

Figure 4:
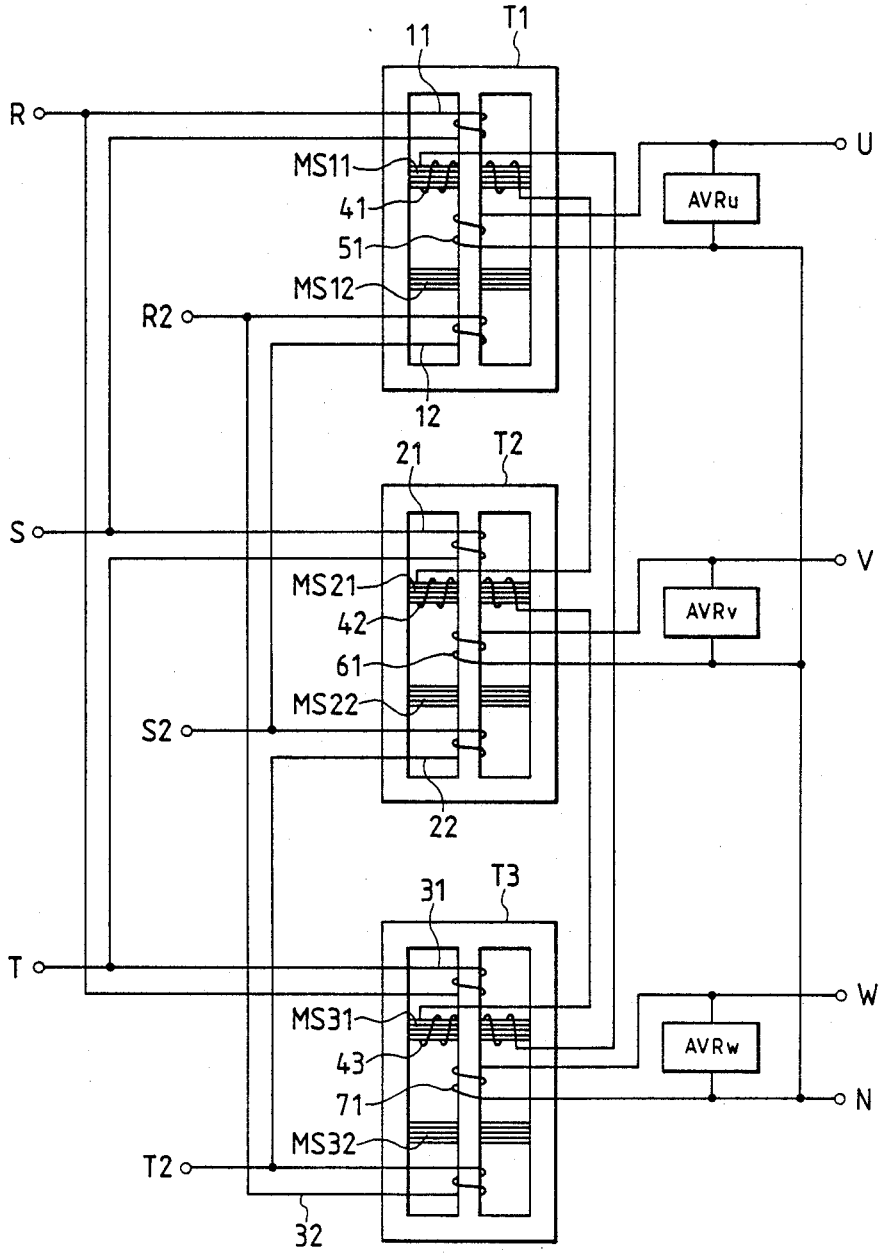
Figure 8:
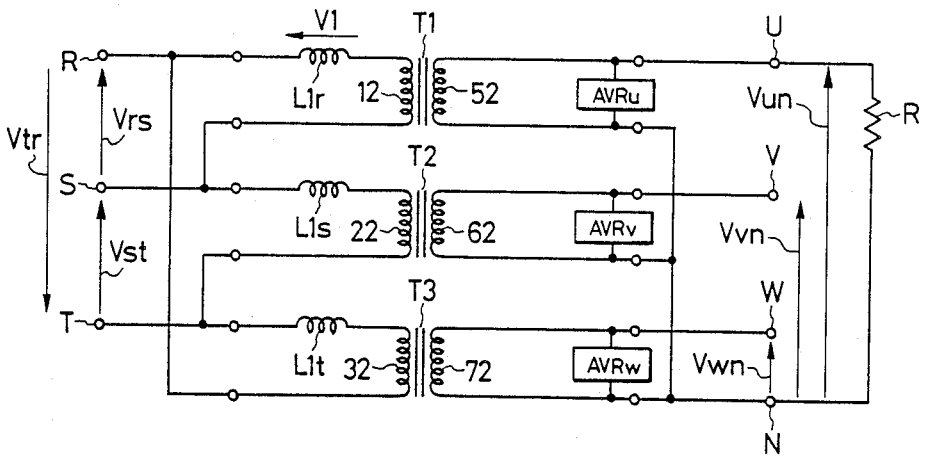
FIG. 8 PRIOR ART
FIG. 8 is a circuit diagram illustrating another ferroresonant three-phase constant AC voltage system of the prior art.
Figure 9:
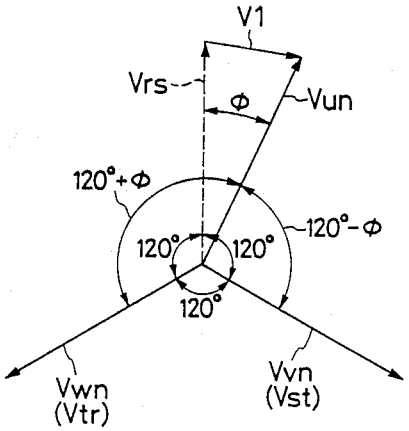
FIG. 9 PRIOR ART
FIG. 9 is a vector diagram for explanation of the operation of the system illustrated in FIG. 8.

FIG. 4 is a schematic diagram of still another embodiment of the present invention which is applied to a triport type constant voltage transformer system. In FIG. 4, the same symbols as used in FIG. 1 denote identical or equivalent parts.

The three-phase triport transformers T1, T2 and T3 are provided with a pair of magnetic shunts MS11 and MS12, MS21 and MS22, and MS31 and MS32, respectively, to thereby prepare three winding sections in each iron core of each of transformers T1, T2 and T3.

The primary (input) windings 11, 21 and 31 are connected, respectively, to a commercial power source and are each wound on the first winding section of transformers T1, T2 and T3, respectively. The windings T1, T2 and T3 are connected to a standby power source and are wound on the third winding section of each of the transformers, T1, T2 and T3. The (output) windings 51, 61 and 71, which are equal in turns to each other, are also wound in the second or central winding section of the transformers T1, T2 and T3, respectively. Of course, it is an optional matter, according to circumstances, which of the primary input windings and the secondary output winding is formed in which of said three winding of a transformer.

On the primary sides of the transformers, the first set of windings 11, 21 and 31 are connected to each other in a delta-connection, and further connected to three-phase (commercial power source) input terminals R, S and T, respectively. Similarly, the second set of windings 12, 22 and 32 are joined to each another in other delta-connection, and further connected to other three-phase input terminals R2, S2 and T2 of a second power source or the standby power source (for example, an inverter power source).

The compensating windings 41, 42 and 43 are formed on the magnetic shunts MS11, MS21 and MS31 of the transformers T1, T2 and T3, respectively, and these compensating windings are connected to each other also in yet series to form a closed loop circuit. In other words, the compensating windings 41, 42 and 43 are joined to each other also in yet another delta-connection.

It is desirable to select the number of turns of compensating windings 41, 42 and 43 in order that the ratio of the number of turns of the compensating winding to each theoretical number of turns corresponding to the equivalent inductance component obtained with the magnetic shunts MS11, MS12 and MS31 are equal to each other for all of three phases.

In FIG. 4, other compensating windings which are the same as those formed on the magnetic shunts MS11, MS21 and MS31 are also formed on the magnetic shunts MS12, MS22 and MS32 of the transformers, respectively, though the compensating windings on the magnetic shunts MS12, MS22 and MS32 are not illustrated in FIG. 4 for simplification of illustration. The compensating windings on the magnetic shunts MS12, MS22 and MS32 are also connected to each other in series to form another closed loop circuit.

It is obvious, in comparison with FIG. 3, that the transformer system in FIG. 4 corresponds to adding the standby power source and the second set of primary windings to the embodiment of the FIG. 3. Consequently, a transformer system which has eliminated the standby power source and the second set of primary windings from the configuration shown in FIG. 4 corresponds to the system shown in FIG. 3 and is put into operation the same way as that shown in FIG. 3.

In other words, when electric power is supplied to the loads from the commercial power source terminals R, S and T, the secondary output voltages U, V and W are kept balanced in the same way as in FIG. 3 even in the case that the secondary side loads or the primary input voltages or both are unbalanced to any extent.

It is also evident that when electric power is supplied to the loads from the standby power source terminals R2, S2 and T2, the equivalent circuit and the relations between voltage vectors are same as those in FIG. 2. Consequently, in the embodiment of FIG. 4, the secondary output voltages U, V and W are always kept balanced under the condition of either balance or unbalance occurring in the secondary side loads or the primary input voltages or both.

Figure 5:
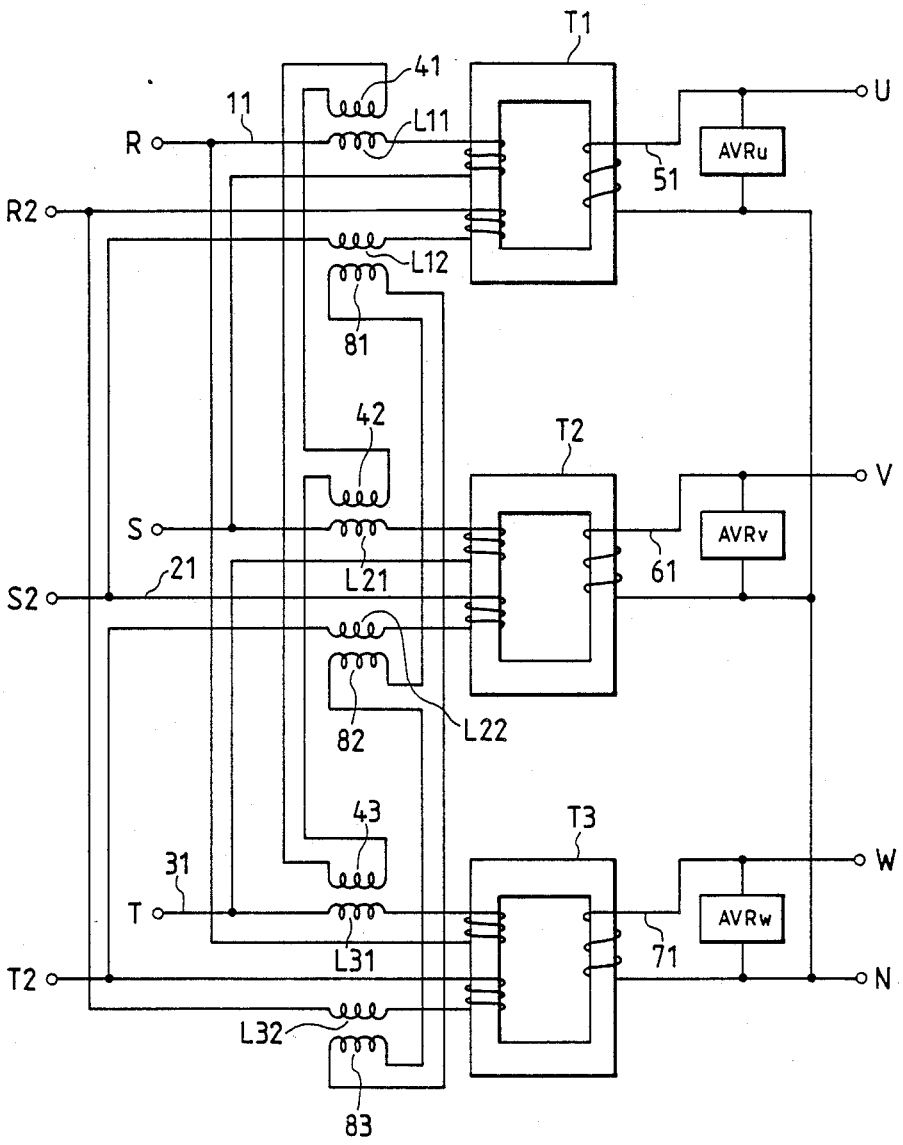

The configuration of FIG. 5 is not provided with the magnetic shunts of the transformers employed in the transformer system illustrated in FIG. 4. Instead, in FIG. 5, the external reactors L11, L21 and L31, and L12, L22 and L32 are serially connected to two sets of primary input windings of the transformers T1, T2 and T3, respectively, to substitute for the reactance components being obtained with the magnetic shunts in FIG. 4.

It is readily inferred from the above explanation relating to the embodiment in FIG. 4 that, in the embodiment in FIG. 5, the phases of the secondary output voltages are always kept balanced even when the loads or the primary input voltages or both of the transformers are unbalanced, without regard as to which power source, the commercial power source or the standby power source, supplies the electric power to the loads.

The embodiments described hereinbefore have been with the assumption that the turn ratio of the theoretical number of turns corresponding to the reactance component by the magnetic shunts to the compensating windings wound on the magnetic shunts, or the turn ratio of the externally connected series reactors to the compensating windings inductively coupled with the series reactors are equal, respectively. However, it will be readily understood that the same, or almost the same, effects as mentioned above are achieved even when the turn ratio mentioned above is not thoroughly balanced.

The embodiments described above have been with the assumption of as using an automatic voltage regulating means of the type provided with a feedback circuit. As is easily inferred from what has been described above, the automatic voltage regulating means may be of some other suitable type. In the embodiments described above, the windings on the primary side have been assumed as being connected in the delta connection pattern and those on the secondary side connected in the Y connection pattern. Of course, any one of the two connection patterns mentioned above can be optionally adopted for the primary and secondary side winding connections.

Effect of the Invention:

As is evident from the description given above, the present invention brings about the following effects:

(1) The deviation produced in phase difference between the output voltage phases when the three-phase loads or the three-phase input power source voltages, or both, go out of balance can theoretically be decreased to zero.

(2) The power capacity on the input side can be minimized because the current-limiting effect is maintained by maximizing the magnitude of reactance of the series reactors inserted on the input side.

What is claimed is:

1. A ferroresonant three-phase constant AC voltage transformer comprising:

three magnetically permeable transformer cores, a primary side winding and a secondary side winding formed on each of said transformer cores, three input terminals, three input means each of which can be in an inductive coupling and each of which provides an inductive reactance effectively in series with a corresponding one of said primary side windings to thereby form three primary phase winding units each in a predetermined connection pattern to the three input terminals, automatic voltage regulating means for controlling secondary side output voltages generated at the secondary side windings to a predetermined value, three compensating windings each formed so as to be inductively coupled with a corresponding one of said input means, and means for connecting said compensating windings to each other in series to form a series closed loop circuit.

2. The ferroresonant three-phase constant AC voltage transformer according to claim 1 wherein each said input means is realized with a reactor, and a turn ratio of a number of turns of a reactor to that of its corresponding compensating winding is substantially equal to such turn ratios for the other reactors and corresponding compensating windings.

3. The ferroresonant three-phase constant AC voltage transformer according to claim 1 wherein each said input means is realized by a magnetic shunt fixed on the corresponding transformer core with the corresponding compensating winding formed on that said magnetic shunt.

4. The ferroresonant three-phase constant AC voltage transformer comprising:

three magnetically permeable transformer cores, first and second primary side windings and a secondary side winding formed on each of the transformer cores, two sets of three input terminals;

six input means each of which can be in an inductive coupling and each of which provides an inductive reactance effectively in series with a corresponding one of said primary side windings to thereby form two sets of three primary phase winding units each, and with each such set in a predetermined connection pattern to a corresponding one of the two sets of three input terminals, automatic voltage regulating means for controlling secondary side output voltages generated at the secondary side windings to a predetermined value, six compensating windings each formed so as to be inductively coupled with a corresponding one of said input means, and means for connecting those said compensating windings corresponding to one of said two sets of primary phase winding units to each other in series to form a closed loop circuit, and means for connecting those said compensating windings corresponding to the other of said two sets of primary phase winding units to each other in series to form another closed loop circuit.

5. The ferroresonant three-phase constant AC voltage transformer according to claim 4 wherein each said input means is realized with a reactor, and a turn ratio of a number of turns of a reactor to that of its corresponding compensating winding is substantially equal to such turn ratios for the other reactors and corresponding compensating windings.

6. The ferroresonant three-phase constant AC voltage transformer according to claim 4 wherein each said input means is realized by a magnetic shunt fixed on the corresponding transformer core with the corresponding compensating winding formed on that said magnetic shunt.

* * * * *